US006386780B1

(12) United States Patent
Brummernhenrich

(10) Patent No.: US 6,386,780 B1
(45) Date of Patent: May 14, 2002

(54) BALLPOINT PEN WITH VISUAL WINDOW AND SLEEVE

(76) Inventor: Klaus Brummernhenrich, Asperheide 21, Bad Salzuflen (DE)

( * ) Notice: Subject to any disclaimer, the term of this patent is extended or adjusted under 35 U.S.C. 154(b) by 0 days.

(21) Appl. No.: 09/144,430

(22) Filed: Aug. 31, 1998

(30) Foreign Application Priority Data

Sep. 6, 1997 (DE) ..... 297 16 002 U

(51) Int. Cl.[7] ..... B43K 29/00
(52) U.S. Cl. ..... 401/192; 401/195; 40/334
(58) Field of Search ..... 401/192, 195; 40/334

(56) References Cited

U.S. PATENT DOCUMENTS 2,896,348 A * 7/1959 Herne ..... 40/334
2,971,283 A * 2/1961 Parker ..... 40/334
3,343,293 A * 9/1967 Kirklen ..... 40/334

* cited by examiner

*Primary Examiner*—Gregory L. Huson
*Assistant Examiner*—Peter deVore
(74) *Attorney, Agent, or Firm*—Charles E. Baxley

(57) ABSTRACT

A press-action ballpoint pen includes a hollow shank which has an elongated viewing window. A printed sleeve is rotationally mounted within the hollow shank for rotation past the viewing window upon actuation of a press-action mechanism which operates the ink cartridge.

5 Claims, 2 Drawing Sheets

BALLPOINT PEN WITH VISUAL WINDOW AND SLEEVE

BACKGROUND OF THE INVENTION

1. Field of the Invention

The present invention relates generally to the field of ballpoint pens and more particularly to a press-action ballpoint pen with a shank having at least one elongated viewing window and a printed sleeve which rotates past the viewing window through a predetermined angle upon actuation of an operating mechanism.

2. Prior Art

Press-action ballpoint pens in the prior art typically utilize an operating mechanism which includes a cross-piece which receives the inner end of the ink cartridge and a pressing device which is coaxial with the cross-piece.

In ballpoint pens according to the prior art the cross-piece is inserted into a printed sleeve in such a way that there is an axially fixed connection between the printed sleeve and the cross-piece. Accordingly, the printed sleeve follows not only the rotary movement of the cross-piece but also the axial displacement thereof, with the result that advertising imprints on the printed sleeve which are to be aligned in each case with the viewing window of the mechanism sleeve have to be matched, particularly as regards their line length, to the axial travel of the printed sleeve in such a way that they can be read in their entirety through the viewing window. Therefore, in accordance with the two axial positions which can be assumed by the printed sleeve, given a full line length corresponding to the length of the viewing window it is necessary that the printed lines be alternately offset with respect to one another in the circumferential direction. In addition it is considered undesirable if the operating travel of the operating mechanism can be seen through the viewing window. Depending on how the pressing device is held, the pressing device is usually actuated by means of an operating button, a displacement of the script or of the pictorial representations on the printed sleeve is produced through the viewing window and this displacement is considered to be undesirable.

OBJECTS AND SUMMARY OF THE INVENTION

It is therefore an object of the present invention to provide a press-action ballpoint pen with a viewing window and a printed sleeve.

Another object of the present invention is to provide a press-action ballpoint pen in which a printed sleeve rotates in a viewing window and is not axially displaced during operation.

Yet another object of the present invention is to provide a press-action ballpoint pen which comprises a relatively small number of component parts which are economical to manufacture, resulting in a relatively low overall cost.

The foregoing and other objects and advantages of the present invention will appear more clearly hereinafter.

In accordance with the present invention there is provided a press-action ballpoint pen with a hollow shank having an elongated viewing window. A printed sleeve is mounted for rotation past the viewing window through a predetermined angle upon actuation of an operating mechanism which operates the ink cartridge.

The operating mechanism includes a cross-piece, which receives the inner end of the cartridge, and also a pressing device, which is coaxial with the cross-piece. The cross-piece is engaged via teeth both with the pressing device and with the shank interior in such a way that each time the pressing device is pressed in axially, counter to the force of a spring which supports the cartridge, the cross-piece is axially displaced, rotated through the predetermined angle and held alternately in two axial positions which differ from one another by the operating travel. The cross-piece is furthermore connected to the printed sleeve in a manner which is fixed against rotation.

The printed sleeve and the crosspiece are connected to one another in a manner fixed against rotation, but are axially loose with respect to one another. The structure and the functioning of the operating mechanism can remain unchanged, which means that there is no change to the actuating sequence for transferring the ballpoint pen cartridge into the writing position and back. With regard to the printing of the printed sleeve, an optimum orientation of the printed lines relative to one another is afforded and, moreover, the entire format of the viewing window can be better utilized. This applies to printing of the printed sleeve with lines of text, and to printing of the printed sleeve with picture elements which appear in the viewing window of the mechanism sleeve.

In an alternative embodiment of the invention, the driving contours on the printed sleeve are designed as axial grooves, which are expediently arranged diametrically opposite one another on the inner wall of the printed sleeve. The cross-piece is correspondingly equipped with driving cams projecting on the outer side.

BRIEF DESCRIPTION OF THE DRAWINGS

Other important objects and advantages of the present invention will be apparent from the following detailed description taken in connection with the accompanying drawings wherein like numerals refer to like parts and in which.

DETAILED DESCRIPTION OF THE INVENTION

Figure 2:
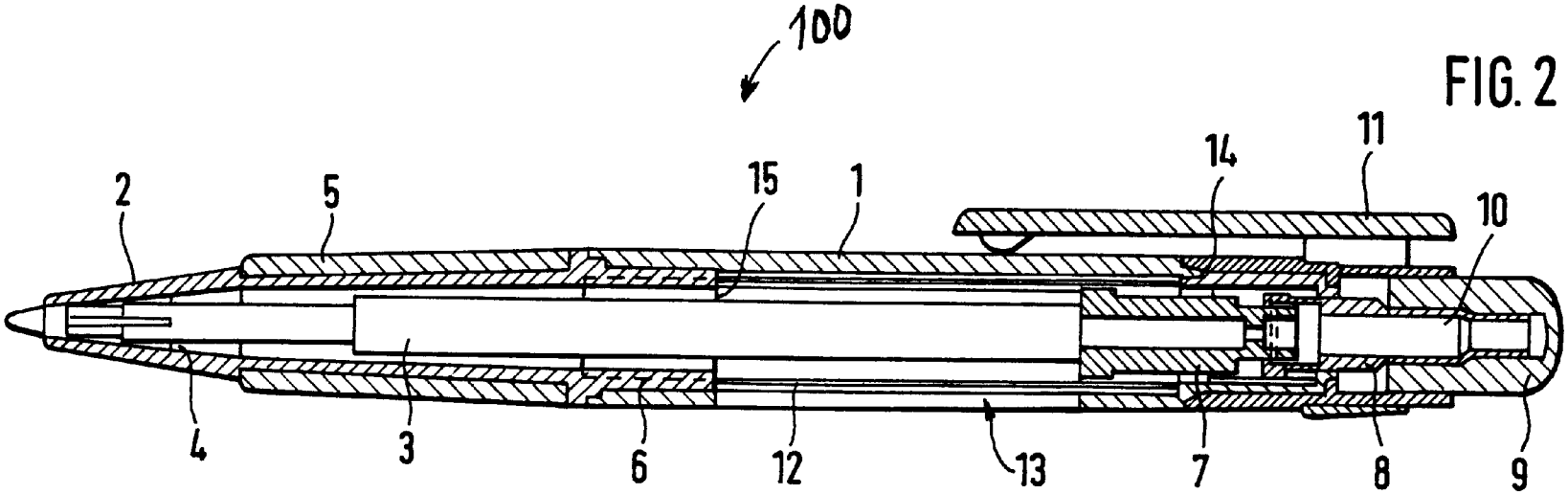
FIG. 2 is a sectional view of the press-action ballpoint pen of FIG. 1, with the cartridge pressed out and situated in the writing position.
Figure 1:
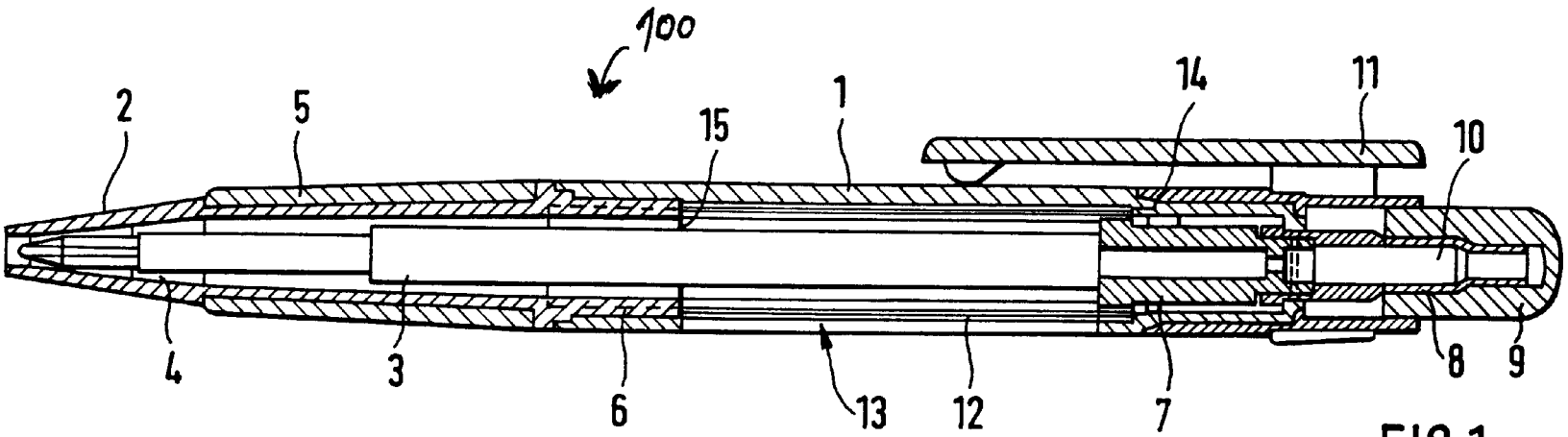
FIG. 1 is a diagrammatic longitudinal section through a press-action ballpoint pen made in accordance with the present invention with a retracted cartridge situated in its position of rest.
Figure 3:
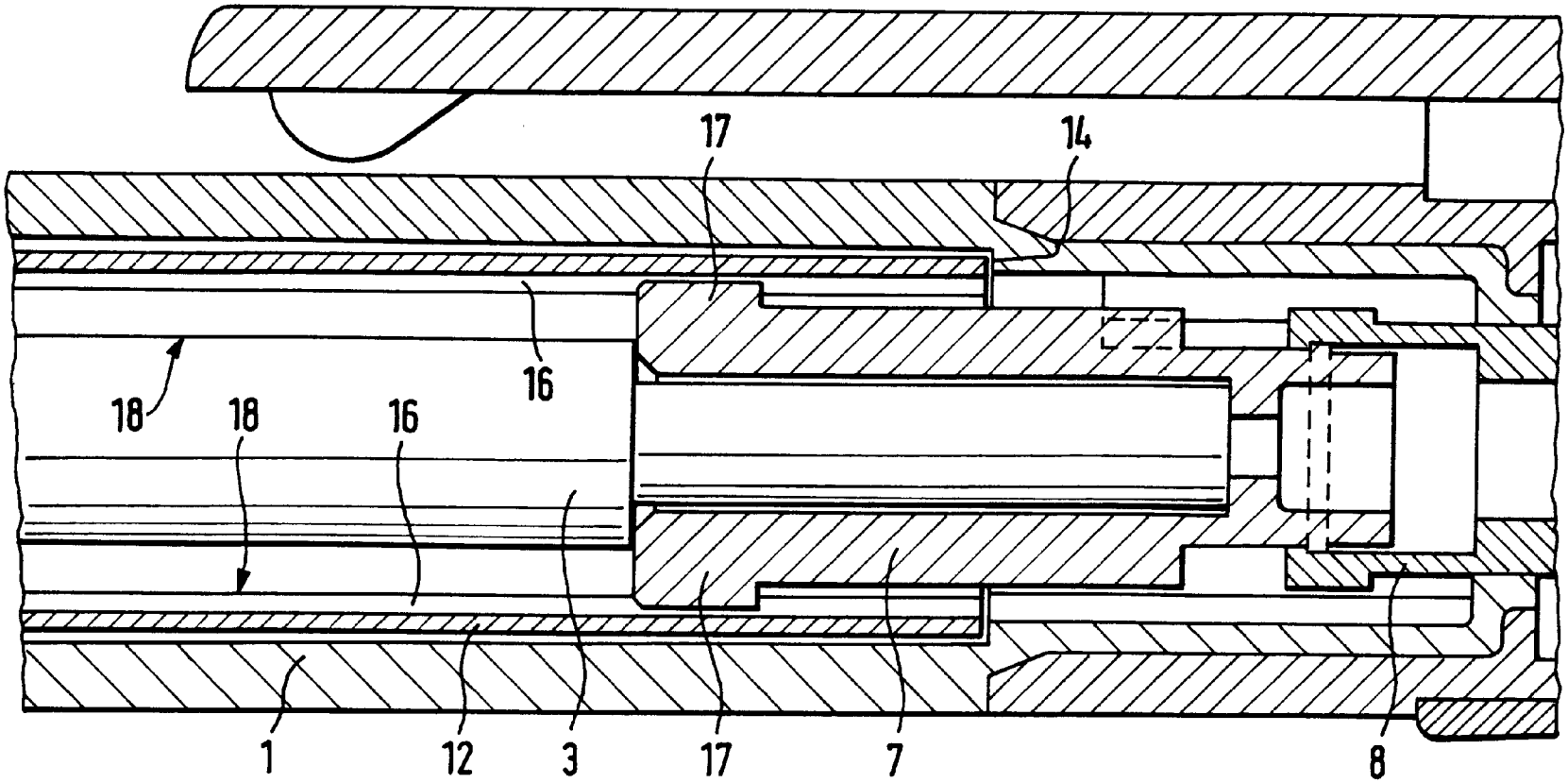
FIG. 3 is a fragmentary sectional view of the ballpoint pen of FIG. 2 showing the central section of the ballpoint pen drawn to an enlarged scale.

Referring to the drawings, wherein like reference numbers designate like or corresponding parts throughout, there is shown in FIGS. 1–3 a press-action ballpoint pen with viewing window and printed sleeve 100 made in accordance with the present invention.

A hollow shank 1 in the form of a sleeve, which constitutes the base body of the press-action ballpoint pen 100, can be seen in FIGS. 1 and 2. Attached to the front end of the shank 1 is a top 2 in which the ballpoint pen cartridge 3 is guided in a longitudinally displaceable manner. Cartridge 3 is supported by means of a radial shoulder near its front end with the interposition of a compression spring 4 in the interior of the tip 2. A rubber collar 5 may be placed onto the tip 2, which rubber collar enhances the writing comfort and also facilitates assembly and disassembly of the ballpoint pen because the tip 2 is releasably connected to the shank 1 via a thread 6.

At the opposite end, the cartridge 3 is held in the interior of the shank 1 in a longitudinal hole in a cross-piece 7 which is axially adjoined, at the end remote from the cartridge 3, by a pressing device 8 whose rear end is enclosed by a pressing-device cap 9 projecting at the rear end of the shank 1. By means of the pressing-device cap 9 and the pressing device 8, the cross-piece 7 and the cartridge 3 can be axially displaced counter to the force of the spring 4, by which means the cartridge 3 can assume, on the one hand, the retracted position of rest illustrated in FIG. 1 and, on the other hand, the extended writing position shown in FIG. 2.

The cartridge 3 is transferred from the position of rest into its writing position by a single actuation of the pressing-device cap 9, and said cartridge returns to its position of rest after another actuation of the pressing-device cap 9. This is effected by toothings which take effect between the cross-piece 7 and the pressing device 8, on the one hand, and between the pressing device 8 and the interior of the shaft 1, on the other hand, in the course of each operating travel the cross-piece 7 and the cartridge 3 not only being axially displaced but also being rotated through a predetermined angle in the circumferential direction, that is to say about their longitudinal axis. A further compression spring 10 is additionally situated between the pressing-device cap 9 and the pressing device 8. The spring 10 prevents the pressing device cap 9 from collapsing inward when the cartridge 3 is in the pushed-forward writing position. Furthermore, a clip 11 is also situated on the outer side of the shank 1 so that the press-action ballpoint pen 100 can be secured in a pocket.

The rotation of the cross-piece 7 that is affected in the course of each operating travel of the cartridge makes it possible to arrange a so-called printed sleeve 12 in the interior of the shank 1. The printed sleeve 12 surrounds the cartridge 3 and is connected to the cross-piece 7 in a manner fixed against rotation and which consequently follows the rotation thereof through the predetermined angle in the course of each operating travel. The printed sleeve 12 is visible through at least one elongate window 13 extending in the axial direction in the shank 1, thereby enabling lines of text or picture motifs to be applied to the exterior of the printed sleeve 12, which lines of text or picture motifs move past the viewing window 13 in the circumferential direction with the operating travels of the cartridge 3. The viewing window 13, or the two or more viewing windows arranged on the shank 1 spaced apart in the circumferential direction, are produced in one piece with the entire shank 1. In the following particular method the shank 1 has an internal, transparent mechanism sleeve which is externally encapsulated by injection molding in color, only the regions of the viewing windows 13 are free of color.

FIG. 3 shows the special feature of the press-action ballpoint pen 100 which resides in the fact that the printed sleeve 12 does not follow the axial movement of the cross-piece 7, which occurs in the course of each operating travel. Consequently in the axial direction the cross-piece 7 is loose relative to the driver sleeve 12 but, on the other hand, is connected in a manner fixed against rotation in the circumferential direction or direction of rotation. For this purpose, the cross-piece 7 has driving cams 17 projecting in the radial direction on the outer side, two of which cams are expediently present disposed diametrically opposite one another. These driving cams engage in driving grooves 16 on the inner wall of the printed sleeve 12 which run axially parallel. Two driving grooves 16 situated diametrically opposite one another are provided here corresponding to the number and arrangement of the driving cams 17 on the cross-piece 7. In principal, these driving contours 16 and 17 between the cross-piece 7 and the printed sleeve 12 can also be designed differently as long as the relative axial non-displaceability between these two parts, on the one hand, and the rotary driving, on the other hand, is ensured.

In order to prevent the printed sleeve 12 from being driven along by the cross-piece 7 in the axial displacement direction thereof owing to friction or the like, radially inwardly projecting shoulders 14 and 15 are present in the interior of the shank 1, by which means the printed sleeve 12 is held non-displaceably in the axial direction in the interior of the shank 1. At the end of the shank 1 on the pressing device 8 side, the shoulder 14 is formed directly by the material of the shank, while on the axially opposite side the shoulder 15 is formed by the end of the tip 2, which projects into the shank 1.

The foregoing specific embodiments of the present invention as set forth in the specification herein are for illustrative purposes only. Various deviations and modifications can be made within the spirit and scope of this invention, without departing from the main theme thereof.

What is claimed is:

1. A press-action ball point pen, comprising:

a) a hollow shank having an interior portion;

b) a cartridge having an inner end;

c) an elongated viewing window disposed on said hollow shank;

d) operating mechanism means for operating said cartridge;

e) printed sleeve means rotationally mounted in said hollow shank for rotation past said elongated viewing window; said operating mechanism comprising:

i) cross-piece means disposed receiving said inner end of said cartridge;

ii) pressing means disposed coaxial with said cross-piece means;

iii) spring means supporting said cartridge; and iv) driving connection means engaging said cross-piece means, said pressing means, and said interior portion of said hollow shank, whereby each time said pressing means is pressed axially, compressing said spring means, said cross-piece means is axially displaced and rotated through a predetermined angle thereby causing rotation of said printed sleeve means past said elongated viewing window through said predetermined angle;

f) mounting means for mounting said printed sleeve means in said hollow shank in an axially non-displaceable manner; said cross-piece means mounted in an axially displaceable manner relative to said printed sleeve means; and g) driving connection means including positive driving contours engaging said printed sleeve means and said cross-piece means.

2. The press-action ball point pen as claimed in claim 1, wherein said printed sleeve means further comprises a plurality of driving grooves and said cross-piece means further comprises corresponding drive cams engaging said driving grooves.

3. The press-action ball point pen as claimed in claim 2, wherein said printed sleeve further comprises a pair of axially parallel driving grooves and said cross-piece means further comprises a pair of corresponding drive cams engaging said axially parallel drive grooves.

4. The press-action ball point pen as claimed in claim 1, wherein said printed sleeve means comprises end surfaces and wherein said hollow shank further comprises a pair of radially inwardly projecting shoulder means with said shoulder means engaged over said end surfaces of said printed sleeve means for axial fixing of said printed sleeve means.

5. The press-action ball point pen as claimed in claim 4, wherein one of said shoulder means further comprises guide means for guiding said cartridge.

* * * * *